United States Patent [19]

Maggi

[11] 4,338,501

[45] Jul. 6, 1982

[54] EXTINGUISHING CHAMBER FOR AN ELECTRIC ARC OF THE MAGNETIC BLOW-OUT TYPE

[76] Inventor: Ernesto Maggi, Viale V. Emanuele 69, 24100 Bergamo, Italy

[21] Appl. No.: 22,351

[22] Filed: Mar. 20, 1979

[30] Foreign Application Priority Data

Mar. 30, 1978 [IT] Italy ..... 21771 A/78

[51] Int. Cl.[3] ..... H01N 33/18

[52] U.S. Cl. ..... 200/147 A; 200/147 R

[58] Field of Search ..... 200/147 A, 147 R

[56] References Cited

U.S. PATENT DOCUMENTS 3,575,635 4/1971 Maggi ..... 200/147 R

*Primary Examiner*—Robert S. Macon

*Attorney, Agent, or Firm*—Stevens, Davis, Miller & Mosher

[57] ABSTRACT

An extinguishing chamber for the electric arc of the magnetic blow-out type, is formed by two symmetrical sections disposed in specular position in relation to a rectilinear or curvilinear axis corresponding approximately to the path of the movable contact of the electric circuit breaker, of which the said extinguishing chamber is a part, and makes use in each section of a constant magnetic field generated by permanent magnets coupled in pairs by means of a yoke of metallic material having a good magnetic permeability and apt to conduct the magnetic return flux generated by the same pairs of permanent magnets externally to the said section. Such field forces said arc to go through a slit delimited by electrically insulating refractory walls, provided in the central part of each section. In each of said sections, in addition to said constant magnetic field, also a supplementary variable magnetic field is caused to develop, said supplementary variable magnetic field having the same direction of the constant field and being generated by one or more electrically insulated windings wound around an additional yoke. The arc during its movement inside the slit of the section concerned, produced by the constant magnetic field, skims over properly shaped connection horns arranged inside said slit and forming the ends of said windings.

9 Claims, 13 Drawing Figures

EXTINGUISHING CHAMBER FOR AN ELECTRIC ARC OF THE MAGNETIC BLOW-OUT TYPE

BACKGROUND OF THE INVENTION

There are already well known types of extinguishing chambers for the electric arc, characterized by the continuous presence, in the region where takes place the separation of the contacts belonging to the interrupting apparatus of which the same chamber is a part, of a constant magnetic field directed transversally to the plane along which the electric arc develops and generated by couples of permanent magnets located along the arc path with the purpose of causing its rapid elongation, together with its extinction at the first favorable passage through the natural zero value of the current flowing through it.

The object of the present invention is an improved extinguishing chamber of the type described above, suitable for operating immersed in an insulating electronegative gas, as sulphur hexafluoride or another similar gas.

SUMMARY OF THE INVENTION

The extinguishing chamber for the electric arc, according to the invention, is of the magnetic blow-out type and is to be associated especially with electric current circuit breakers, intended for use in distribution or transmission circuits; it is suitable, as said above, for operating immersed in an insulating electronegative gas, as sulphur hexafluoride or another similar gas; it is formed by two symmetrical sections disposed in a specular position in relation to a rectilinear or curvilinear axis, corresponding approximately to the path of the movable contact belonging to the interrupting apparatus of which the same chamber is a part; and it makes use, in each section, of a constant magnetic field generated by permanent magnets bound in pairs by yokes of metallic material having a good magnetic permeability and capable of conducting the magnetic back flux generated by each pair of permanent magnets externally to the said section, such constant and permanent magnetic field having the function of urging, as soon as it appears, the electric arc which is forming across the separating contacts of the interrupting apparatus, in the direction of either one of the sections of the extinguishing chamber—according to the polarities of the current half-wave flowing through the circuit at that moment—forcing said arc to run through a slit delimited by two electrically insulating refractory walls, provided in the central part of each section. The same chamber is characterized by having in each section, besides the said constant field, also the means for developing a supplementary variable magnetic field having the same direction of the constant one and being generated by one or more insulated electrical windings, wound around a supplementary yoke, which are caused to carry a portion of the selected half-wave current proportional to the current to be interrupted and supplied by the electric arc itself when, pursuing in its development under the action of the constant magnetic field within the central slit of the section it occupies, it reaches the metallic horns which, properly shaped and arranged within the said slit, form also the ends of the above mentioned windings.

The advantages and improvements deriving from this invention will appear more evident when considering that the extinguishing chamber forming its object provides for:

(a) means for selecting and directing the movement of the electric arc carrying the positive half-wave of the current flowing through it towards the inside of a first section of said chamber, if the separation of the contacts belonging to the interrupting apparatus, of which the same chamber is a part, takes place during the time of flowing in the circuit to be interrupted of a positive half-wave, and for selecting and directing, instead, the movement of the electric arc carrying the negative half-wave of the current flowing through it towards the inside of a second section of said chamber, if the separation of the contacts takes place during the time of flowing in the same circuit of a negative half-wave;

(b) a configuration of the insulating walls, which delimit the slit for the development of the electric arc within either one of the two sections of the extinguishing chamber, such as to cause the rapid elongation and deionisation of the arc itself;

(c) means for protecting the permanent magnets used within the extinguishing chamber against the thermic effects deriving from the direct action of the electric arc on said magnets and against the demagnetizing actions due to the currents flowing either through the contacts of the interrupting apparatus in question during its normal service, in the case of alternating currents, or through the electric arc present inside the extinguishing chamber during the interrupting operations of the said apparatus;

(d) means for developing within each of the said sections a supplementary variable magnetic field, having the same direction of the constant magnetic field produced by the pairs of permanent magnets and being generated by energizing proper electric windings with the half-wave current flowing through the electric arc developing inside the said section;

(e) means for ensuring the immediate return of insulating gas into the slit of the section wherein the electric arc has just developed and extinguished;

(f) means for attenuating both the rate of rise and the amplitude of the transient recovery voltage which appears across the contacts of the interrupting apparatus, of which the extinguishing chamber is a part, immediately after the extinction of the electric arc;

(g) means for protecting the insulating walls mentioned under (b) against the thermic effects deriving from the direct action of the electric arc on said walls.

It is easy to understand how the extinguishing chamber according to the invention allows to accomplish the efficient and rapid interruption of an alternating current circuit, where the current flowing in it passes through its zero value naturally, at each alternation of the current itself; in a direct current circuit, the passage of the current through a zero value can be obtained artificially, only for a very short time, by means of methods well known to the experts in this field. The extinguishing chamber according to the invention may efficiently perform its function in the interrupting operation by making use of the instants in which the current of the direct current circuit passes through its zero value; thus, the extinguishing chamber according to the invention can be used for interrupting both alternating and direct current circuits.

BRIEF DESCRIPTION OF THE DRAWINGS

The structural and operating characteristics, as well as the results which the extinguishing chamber according to the invention is capable of achieving, can more easily be understood by examining the following detailed description, given with reference to the accompanying drawings, provided by way of example but without limiting the scope of the invention itself.

In the drawings.

DESCRIPTION OF THE PREFERRED EMBODIMENTS

With reference firstly to FIGS. 1 to 5 of the accompanying drawings, it should be observed that the arc extinguishing chamber according to this first embodiment of the invention has a configuration which is characterized by the presence of two sections 7 and 8, specularly symmetrical in relation to the axis D–A' of the contacts 18 and 19, belonging to the interrupting apparatus of which the same chamber is a part, and disposed with their longer sides perpendicularly to the said axis. In the three views of FIGS. 1, 2 and 3, the chamber is represented as having, for the sake of simplicity, a rectilinear axis E–F; however, such axis can also take a poligonal or a curvilinear shape without infringing the fundamental operating principles of the chamber itself.

Figure 1:
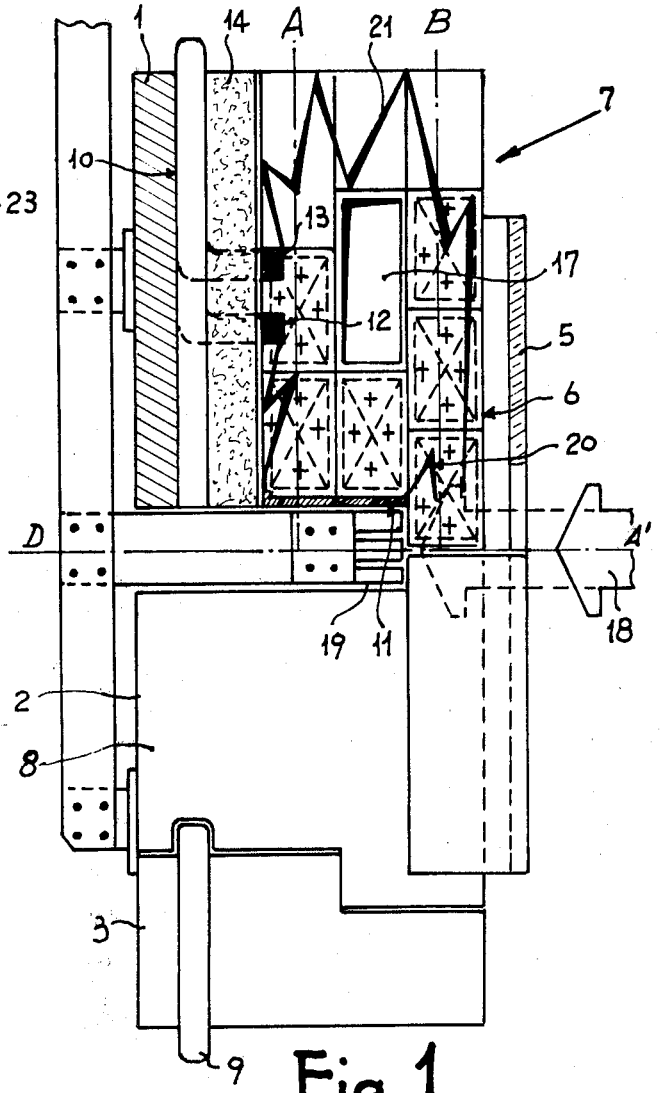
FIG. 1 shows schematically a partial longitudinal section view through one of the possible configurations of the arc extinguishing chamber according to the invention, substantially on the line C—C' of FIG. 2.
Figure 3:
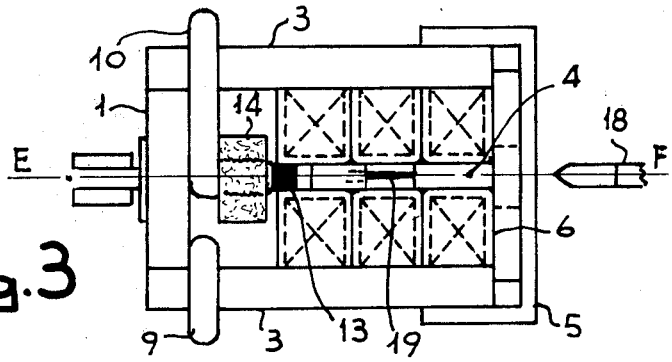
FIG. 3 shows schematically a plan view of the arc extinguishing chamber of FIGS. 1 and 2.
Figure 2:
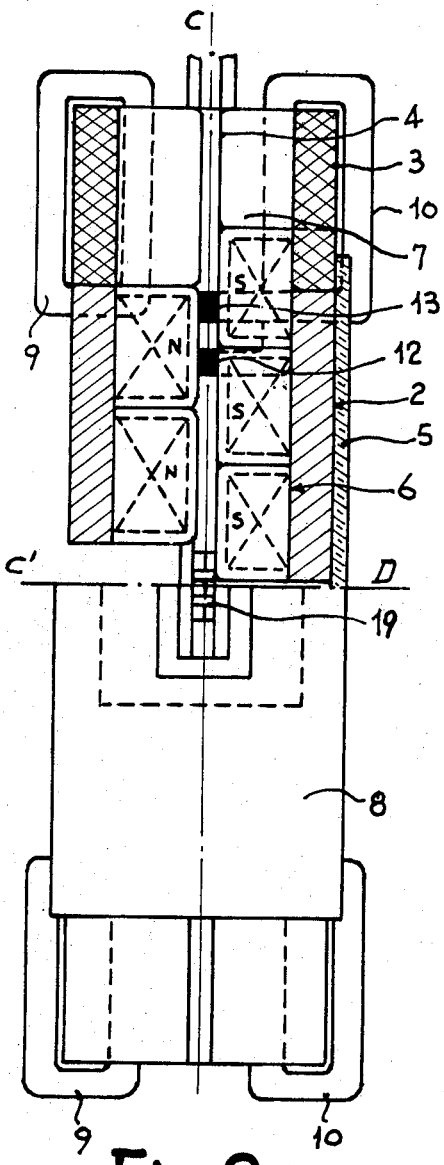
FIG. 2 shows schematically the partial transversal section views through the arc extinguishing chamber represented respectively, on the left side of the drawing, substantially along the line A—A' of FIG. 1 and, on the right side of the drawing, along the line B–A' of FIG. 1.

Within the chamber represented in FIGS. 1, 2 and 3, the sections 7 and 8 are connected through four appendixes of the yokes side walls 2, forming two interrupted bridges, and present along the lines where they meet a canal-shaped space which provides a path for the movable contact 18, belonging to the interrupting apparatus of which the extinguishing chamber is a part: at one end of the same canal is located the stationary contact 19 provided, on each side, with a fork-shaped arcing contact 11 which, lying on the same plane formed by contacts 18 and 19, protrudes inside the central slit 4 existing in each one of the sections 7 and 8.

The yoke 1 as well as the two side walls 2 provided in each section of the same chamber are made of a metallic material having good magnetic permeability; they constitute the return path for the external magnetic fluxes generated by the couples of elementary permanent magnets facing each other and marked on the drawings by dashed diagonal lines; such permanent magnets, being partially enclosed in coverless parallelepiped shaped boxes 6, made of insulating ceramic material capable of resisting to both the electrical and the thermic actions of the electric arc, are firmly set on the metallic side walls 2 and so disposed, on both sides of the central slit 4 wherein the electric arc develops, as to form with their adjacently assembled bottom plates two insulating and refractory walls delimiting the central slit 4 of each section of the extinguishing chamber.

The polarities of the permanent magnets front faces adjacent to the central slit 4 and belonging to each couple of magnets are opposite, as shown by way of example in FIG. 2, wherein the letters N and S indicate respectively the North and South polarities of the permanent magnets front faces.

The ceramic boxes 6 have the internal side walls and bottom plates covered with a thin sheet metal plate of a material having good electric and thermic conductivities, intended to protect the partially enveloped magnets against the demagnetizing and thermic actions produced by the electric currents flowing through the closed contacts of the interrupting apparatus, of which the extinguishing chamber is a part, during the normal service of such apparatus and also through the electric arcs developing inside the chamber sections during the interrupting operations: the configuration of such metal sheet shields allows to maintain, by means of their direct contact with the metal side walls 2, a temperature fairly close to the temperature of said side walls and obtain, thus, a reduction of the temperature transmitted to the permanent magnets through the bottom plates of the ceramic boxes 6 by the electric arc during its permanence within the slit 4.

The external surface of the bottom plates of the boxes 6, exposed towards the slit 4, can be totally or partially covered by a layer of small grains of a refractory material having a good resistance to the thermic action of the electric arc; some boxes 6 can also present on the external surface facing the slit 4 a number of protruding relieves 15 allowing to form, together with similar protruding relieves provided on the boxes forming the opposite wall of slit 4 and properly located on it, a space having the shape of a labyrinth path along the edges of the slit 4 (as shown for example in FIG. 4) which allows also to hold back, trapped inside cavities 16, small amounts of insulating gas, in spite of the violent exit of the gas contained in the slit 4 when overheated by the electric arc. Further small quantities of gas will be held back, for the same purpose, in the upper surface of said insulating walls, having a bee-hive structure.

The constant magnetic field which is generated transversally to the slit 4 by the couples of permanent magnets is integrated, during the interrupting operations, by a supplementary variable magnetic field generated, transversally to the same slit containing the electric arc, by one or more windings 10, electrically insulated from and wound around a side wall 3 of the section of said slit, the ends of such windings being connected to metallic horns 12 and 13. Such supplementary magnetic field is established when the said windings start carrying currents proportional to the half-wave current flowing through the electric arc as soon as the latter, while moving and developing within the central slit 4 of the section, under the actions of both the constant magnetic field and its own magnetic field, comes in touch with the horns 12 and 13 forming the ends of the windings 10.

The slit 4, wherein the electric arc moves and develops under the actions of the aforespecified magnetic fields, is entirely open for what concerns at least the edge facing the side where a bare resistor 14 is located; a corresponding length of the arc is so allowed to emerge from the chamber section and skim over such resistor, which becomes thus connected in parallel with the said arc length.

Figure 4:
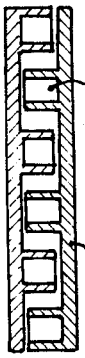
FIG. 4 shows in detail the front view of a labyrinth configuration for the electric arc path, acting also as a vent for the insulating gas heated by the same arc while developing within the central slit of the arc extinguishing chamber of FIGS. 1 to 3.
Figure 5:
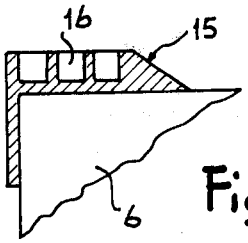
FIG. 5 shows in detail one of the protruding relieves forming, together with the insulating walls delimiting the central slit of the arc extinguishing chamber, the labyrinth of FIG. 4.

The width of slit 4 is not constant throughout all or part of the remaining sides which may be provided with protruding relieves 15, of the type shown in FIG. 5, with the purpose of creating labyrinth paths of the type shown in FIG. 4; in this case, the corresponding lengths of the arc, which is expanding away from the contacts gap in all directions, will meet such relievers 15 which gradually reduce the width of the slit in the regions adjacent to its external edges, in order to prevent the heavy current arcs from travelling past the cavities 16 until the currents flowing through them are reduced to values corresponding to small arc lengths, capable of passing through the labyrinth paths where the gas trapped in the cavities 16 will accomplish the final deionization of the arc. Reference 17, in FIG. 1, indicates an expansion cavity for the gases.

Figure 12:
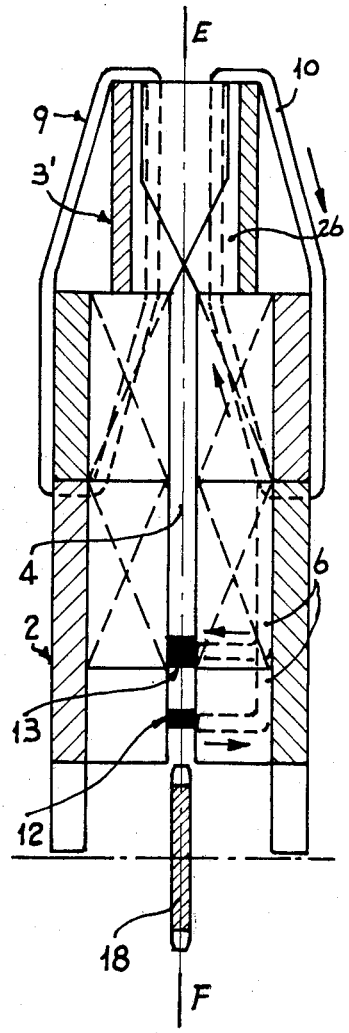
FIG. 12 shows schematically the transversal section view through the same part of the arc extinguishing chamber, substantially on the line G–H of FIG. 11.
Figure 11:
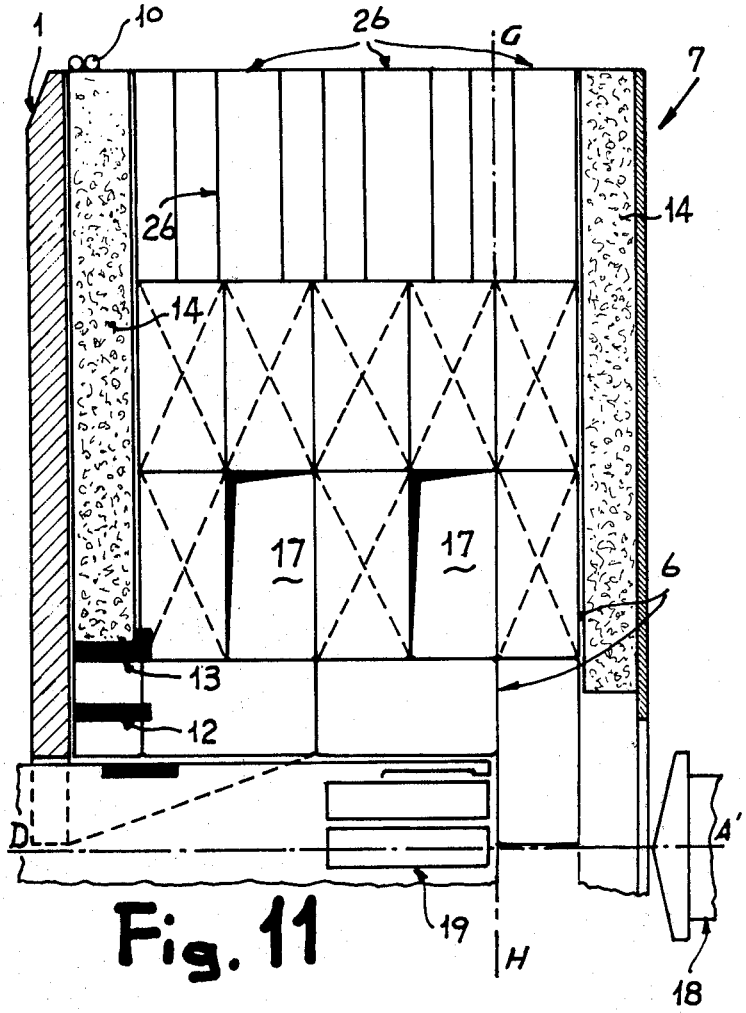
FIG. 11 shows schematically the longitudinal section view through one of the two sections of an arc extinguishing chamber according to the invention, substantially on the line E–F of FIG. 12.
Figure 13:
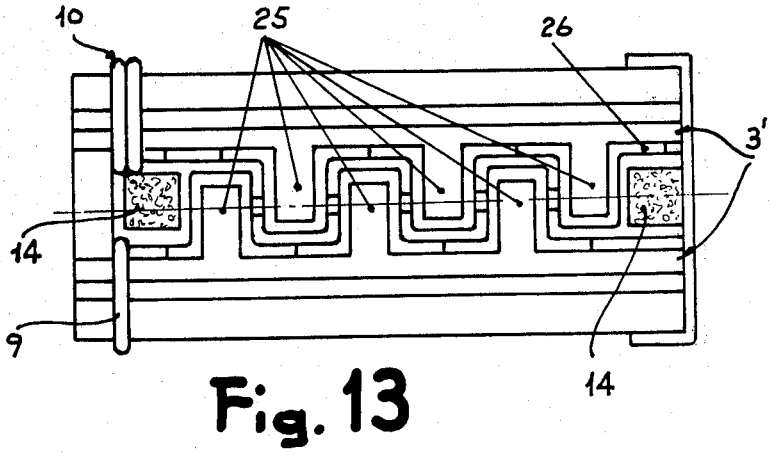
FIG. 13 shows schematically the plan view of the arc extinguishing chamber of FIGS. 11 and 12.

Another embodiment of the extinguishing chamber having an improved labyrinth path for the electric arc is shown in FIGS. 11, 12 and 13, wherein the supplementary magnetic field generated by the windings 10, wound around side walls 3 and 3', is applied across a labyrinth slit wherein the said arc travels during a longer phase of its final displacement. Instead of adopting the protruding relieves of FIG. 5, made of an insulating material having poor magnetic permeability, the labyrinth of FIGS. 11 to 13 adopts the blocks 25 made of a metallic material having a good magnetic permeability. Said blocks 25 are covered by insulating boxes 26 of a material apt to resist to the direct action of the electric arc. Besides, the labyrinth path provided by the arrangement according to FIGS. 12 and 13 is much longer than the labyrinth of FIGS. 4 and 5.

The operation of the extinguishing chamber according to the invention, as heretofore described, is the following:

On a closing operation, the movable contact 18 moves through the canal path provided in the region where the side walls 2 of the two sections 7 and 8 of the chamber meet to form two interrupted bridges, and engages the stationary contact 19 of the interrupting apparatus, of which the extinguishing chamber is a part.

When the interrupting apparatus opens and contacts 18 and 19 separate, an arc is formed across them in the said bridges region where, according to FIG. 1, it is subjected to the action of the constant magnetic field generated by the couples of permanent magnets set on the appendixes of the side walls 2 and directed transversally to the slit 4, as indicated in the drawing by small crosses. If, at the moment when contacts 18 and 19 separate, the circuit to be interrupted is carrying a positive half-wave current which is directed from contact 19 towards contact 18, the said arc will be urged in the direction of section 7 and will transfer one of its roots on the upper arcing horn 11, while its second root will travel along the front of contact 18. Such arc will thus reach a position similar to 20 in FIG. 1, where its first root will now be urged to travel sideways along the arcing horn 11 inside slit 4; this movement will quickly remove the arc from the gap which has been created between contacts 19 and 18 by the opening operation of the interrupting apparatus. The said first root of the arc travelling along the arcing horn 11 will reach the horn end and stop on it while the arc, under the actions of the constant magnetic field and of its own magnetic field, will expand inside the slit 4 up to reaching the metallic horns 12 and 13 which form the ends of the windings 10. A portion of the arc current, determined by the time constant of the windings 10, enters such windings which become gradually inserted in the circuit to be interrupted. It will thereby be possible to generate a supplementary variable magnetic field across the region of slit 4 corresponding to the side walls 3, proportional to the current flowing through the arc and having the same direction of the constant magnetic field generated by the permanent magnets of section 7. The duration of such supplementary field action depends on the duration of the current half-wave flowing through the arc: besides, a short circuited winding 9, wound around one side wall 3 of the same section 7, is provided for the purpose of delaying the dropping to zero of the supplementary variable magnetic field for a length of time greater than the time required by the circuit current to reach its natural zero value, as well known to experts in this field.

In FIG. 1, the approximate position and shape of the electric arc developing under the actions of the various magnetic fields existing in slit 4 of section 7, has been indicated by 21. The presence of resistor 14, in parallel with one length of said arc, causes both the rate of rise and the amplitude of the transient recovery voltage, appearing across the separated contacts 18 and 19 at the instant of the electric arc extinction, to be considerably attenuated, thus making it easier for the insulating gas contained in the region surrounding the said contacts to withstant such recovery voltage and prevent the arc from restriking. For what concerns the gas contained in the region where the arc has developed, during the time of its existence, the deionizing action of the labyrinth path through which the arc has extended and cooled, together with the rapid return in slit 4 of the gas which has been forced under pressure inside the cavity 17 during the phase of the arc development, combine to restore immediately an atmosphere capable of resisting the said transient recovery voltage appearing across the contacts 18 and 19.

If the separation of the contacts 18 and 19 should take place at an instant too close to the first natural zero of the current flowing through the circuit to be interrupted, to allow a sufficient deionization of the insulating gas contained in the gap formed between said contacts, the arc will restrike across them and will carry a current half-wave of opposite polarity to that of the previous half-wave: the new arc will be urged towards the slit 4 of section 8 where it will develop and be extinguished at the next passage of the current through zero. The time now available will be that of a full half-wave and sufficient for ensuring a proper deionization of the insulating gas contained in the gap formed between contacts 18 and 19, together with the final extinction of the electric arc.

The final extinction of the electric arc within the extinguishing chamber produces the breaking of the circuit to which the interrupting apparatus is connected.

Figure 6:
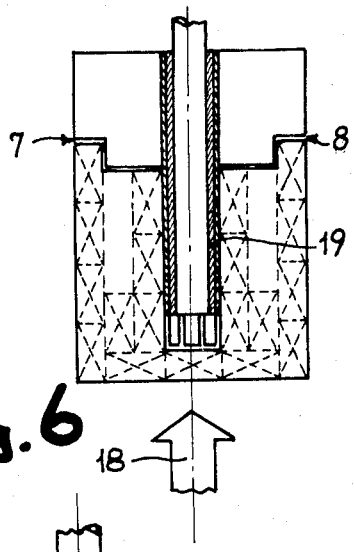
FIG. 6 shows schematically another configuration of the extinguishing chamber according to the invention.

In FIG. 6 is illustrated an embodiment of the extinguishing chamber for the electric arc according to the invention, which is different from the one previously described: the two sections of said chamber are in fact specularly symmetrical in relation to the axis of the contacts of the interrupting apparatus, of which such chamber is a part, but they are disposed with their longer sides lying parallel to said axis (instead of lying perpendicular thereto, as in the embodiment of FIGS. 1 to 3).

Figure 7:
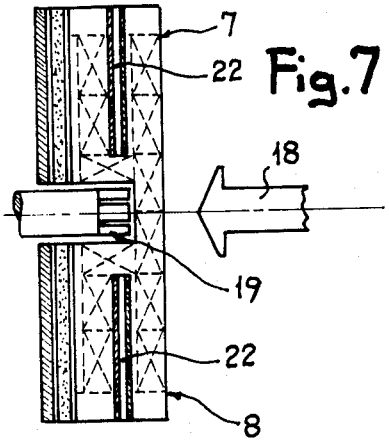
FIGS. 7 and 8 show two variants of the arc extinguishing chambers represented in FIGS. 1 and 6, respectively.
Figure 8:
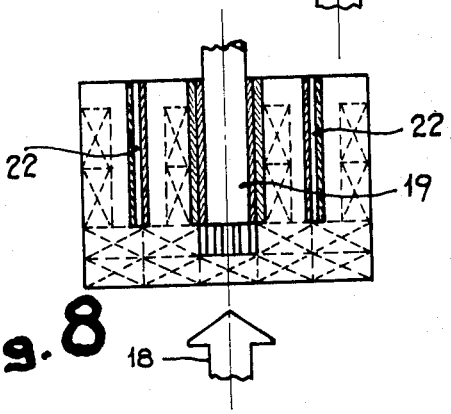

FIGS. 7 and 8 show two modifications of the extinguishing chambers illustrated respectively in FIGS. 1 to 3 and in FIG. 6. In such modifications, each section of said chambers is provided with an insulating barrier 22. Such barrier can also be formed by a couple of parallel insulating ribs which comprise, between them, an opening acting either as a vent, for the exit of the heated gas from the section during the interrupting operations, or as means for facilitating the refilling of the section itself with the fresh external gas, after the extinction of the arc.

Figure 9:
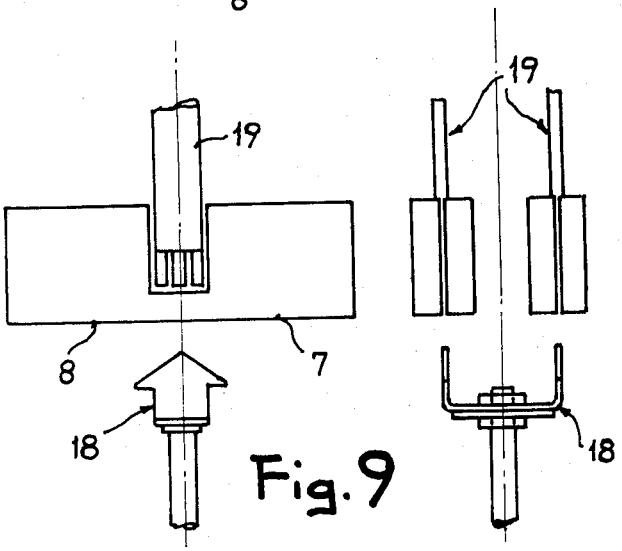
FIG. 9 shows schematically both the longitudinal and front views of the series coupling of two arc extinguishing chambers, similar to the one shown in FIG. 1, for interrupting circuits subjected to voltages which are approximately twice the voltage which can be interrupted by a single extinguishing chamber.

According to the solution shown in FIG. 9, two extinguishing chambers are associated in order to operate on circuits subjected to voltages approximately twice the voltage which can be interrupted by a single extinguishing chamber. In this solution, the movable contact 18 takes the form of a conducting bridge apt to connect across the stationary contacts 19 of the coupled extinguishing chambers.

Figure 10:
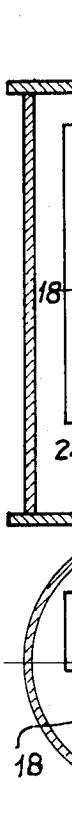
FIG. 10 shows schematically both the transversal and the plan views of a further arrangement of series coupling of two arc extinguishing chambers, similar to that shown in FIG. 1, for interrupting circuits subjected to voltages which are approximately twice the voltage which can be interrupted by a single extinguishing chamber.

According to the embodiment of FIG. 10, two extinguishing chambers are disposed inside an insulated cylinder 23, with their major axes parallel to the axis of the insulating cylinder and with their stationary contacts 19 set in positions being opposed to each other and at different heights; the movable contact 18 is supported by an insulating column 24 which rotates around the axis of the cylinder 23 and operates either the series connection of the two chambers, by rotating in one direction, or their separation, by rotating in the opposite direction.

FIGS. 11 to 13 show a modified embodiment of the extinguishing chamber of FIGS. 1 to 3, particularly significant for the special shape of the labyrinth path adopted therein. When, in this chamber, the electric arc developing in slit 4 invades the labyrinth region delimited by the blocks 25 with their boxes 26, the supplementary variable magnetic field, generated by the windings 10 carrying the positive half-wave of the arc current, and the residual magnetic field determined by the presence of the short circuited windings 9, appear between the opposed blocks 25 and act both on the arc lengths parallel to the bottoms of the boxes 26 and on the arc lengths perpendicular thereto, thereby increasing the efficiency of the action of the electric arc displacement towards the inside of the labyrinth formed by said boxes 26. It is thus possible to obtain a considerably greater extension of the electric arc and to accomplish a total distribution of the magnetic flux capable of extending its action to the entire arc length.

I claim:

1. Extinguishing chamber for the electric arc of the magnetic blow-out type, comprising two symmetrical sections disposed in specular position in relation to an axis corresponding approximately to the path of the movable contact of the electric current circuit breaker, each section having a first yoke of metallic material of good magnetic permeability, permanent magnets coupled in pairs to said yoke to generate a constant magnetic field, said yoke adapted to conduct the magnetic return flux generated by the pairs of permanent magnets externally to said section, electrically insulating refractory walls positioned within each section defining a slit through which the arc passes, a second yoke within each section, electrically insulated windings wound around said second yoke and having connection horns at the end thereof properly shaped and arranged inside said slit to generate a supplementary variable magnetic field having the same direction as the constant field, said windings being run through by unidirectional currents proportional to the current to be interrupted and derived from the electric interruption arc itself when this latter, during its movement inside the slit of the section it occupies, produced by the constant magnetic field, skims over said properly shaped connection horns arranged inside said slit.

2. Extinguishing chamber for the electric arc as in claim 1, wherein the electrically insulating refractory walls delimiting the central slit of each of the two chamber sections, are formed by the adjacently assembled bottom plates of coverless boxes, made of ceramic material and having a parallelepiped shape, containing the elementary permanent magnets generating said constant magnetic field, such permanent magnets being set with their back faces directly on the internal surfaces of the side walls of the magnetic yokes of said sections, the said ceramic boxes being capable of resisting to both the chemical actions of the electronegative gas surrounding the extinguishing chamber and of the products of the gas dissociation caused by the high temperatures of the electric arcs, and the thermic actions of the said electric arcs.

3. Extinguishing chamber for the electric arc as in claim 1 or 2, including shields made of a metal sheet material having good conductivity for both heat and electricity, suitably shaped and sized to line the inner side walls and the inner bottom part of said ceramic boxes and to cover said elementary permanent magnets, in order to protect such magnets both against the thermic actions of the electric arc—when the same travels inside the central slit of either section—by keeping the walls of said boxes bearing against the yokes side walls at a temperature close to that of said yokes, and against the demagnetizing actions due to both the currents normally flowing through the closed contacts of the interrupting apparatus, of which the extinguishing chamber is a part, and the currents flowing through the arcs developing inside said slits during the interrupting operations of said apparatus.

4. Extinguishing chamber for the electric arc as in claim 1 or 2, wherein the surfaces of the insulating walls exposed to the electric arc are provided, on some regions adjacent to their external edges, with protruding and insulating relieves, so disposed as to give a labyrinth shape to part of the slit wherein the electric arc develops, such relieves having on their upper surface a bee-hive structure allowing to hold back, trapped in the cavities forming the bee-hive, small amounts of insulating gas useful for the electric arc deionization.

5. Extinguishing chamber for the electric arc as in claim 1 or 2, wherein from the side walls (in the said slit through which the electric arc travels) between which the supplementary variable magnetic field is generated, there project—only from the region adjacent to the central edge of the slit containing said arc—small blocks of metallic material with good magnetic permeability, covered by insulating boxes adapted to resist the direct action of the electric arc, said blocks being so disposed as to form into a labyrinth the path for said arc in the said region.

6. Extinguishing chamber for the electric arc as in claim 1 or 2, including bare electrical resistors, made of a material capable of resisting the direct thermic action of the electric arc, and disposed along one or both of the lateral edges of the slit wherein the arc develops, so as to be skimmed on by the said arc and influence favorably its extinction by attenuating both the rate of rise and the amplitude of the transient recovery voltage appearing across the separated contacts of the interrupting apparatus at the instant of the electric arc extinction.

7. Extinguishing chamber for the electric arc as in claim 1 or 2, including in each one of the two sections forming said chamber, one or more cavities facing the central slit delimiting the path of the electric arc and containing amounts of insulating gas, sufficient to restore in such slit an atmosphere having a good dielectric strength, immediately after the electric arc passage and the reduction of the overpressure produced by said arc within said slit.

8. Extinguishing chamber for the electric arc as in claim 1 or 2, wherein the surfaces of the insulating refractory walls exposed to the direct action of the said arc are totally or partially covered by a layer of grains of a refractory material adapted to resist the thermic action of the electric arc, in order to protect such surfaces from the effects of said thermic action by preventing their direct contact with the electric arc.

9. Assembly of two or more extinguishing chambers for the electric arc, as in claim 1 or 2, operating together for the interruption of circuits subjected to particularly high voltages.

* * * * *